US010865555B2

(12) United States Patent
Abrahams

(10) Patent No.: US 10,865,555 B2
(45) Date of Patent: Dec. 15, 2020

(54) EMESIS FUNNEL ASSEMBLY

(71) Applicant: Karl Abrahams, Gonzales, LA (US)

(72) Inventor: Karl Abrahams, Gonzales, LA (US)

( * ) Notice: Subject to any disclaimer, the term of this patent is extended or adjusted under 35 U.S.C. 154(b) by 0 days.

(21) Appl. No.: 16/385,526

(22) Filed: Apr. 16, 2019

(65) Prior Publication Data

US 2020/0332508 A1 Oct. 22, 2020

(51) Int. Cl.
*E03D 9/00* (2006.01)
*B67C 11/02* (2006.01)
*E03D 11/00* (2006.01)

(52) U.S. Cl.
CPC ..... *E03D 9/00* (2013.01); *B67C 11/02* (2013.01); *E03D 11/00* (2013.01); *E03D 2201/00* (2013.01)

(58) Field of Classification Search
CPC ..... E03D 9/00; E03D 11/00; E03D 2201/00; B67C 11/02
See application file for complete search history.

(56) References Cited

U.S. PATENT DOCUMENTS 2,858,939 A * 11/1958 Corliss ..... B64D 1/16 210/136
2,907,048 A * 10/1959 Gould ..... E03C 1/01 4/663
3,500,480 A * 3/1970 Michal, Jr. ..... E03D 11/025 4/301
4,137,579 A 2/1979 Soler
4,282,611 A * 8/1981 O'Day ..... E03D 11/025 4/144.1
4,285,076 A * 8/1981 Dickstein ..... A61F 5/445 4/300.2
4,990,145 A * 2/1991 Fleury ..... A61G 9/006 604/317
5,090,067 A * 2/1992 Cogdill ..... E03D 9/085 4/420.2
5,153,947 A * 10/1992 Markles ..... E03D 11/13 285/56
D346,016 S 4/1994 McClelland
5,375,862 A * 12/1994 Sirianno ..... B62B 3/00 141/88
5,390,374 A 2/1995 Hubrig
5,575,020 A * 11/1996 Hubrig ..... E03D 1/003 4/342
5,737,779 A 4/1998 Haddock
5,819,331 A * 10/1998 Miuccio ..... E03D 11/025 4/341
5,971,969 A 10/1999 Cashel
6,079,057 A * 6/2000 Mette ..... E03D 1/003 4/342

(Continued)

*Primary Examiner* — Nicolas A Arnett

(57) ABSTRACT

A emesis funnel assembly for facilitating a person sitting on a toilet to vomit into the toilet includes a stand is removably positionable around a toilet. A funnel is coupled to the stand, the funnel has a top end and a bottom end, and the funnel tapers inwardly between the top and bottom ends. The funnel is positionable in a deployed position having the top end being aligned with the person's mouth and having the bottom end being directed between the user's legs toward the toilet. In this way the funnel can direct emesis into the toilet. A hose is coupled to the stand, the hose is fluidly coupled to a fluid source and a spray nozzle is fluidly coupled to the hose for washing vomit from the funnel.

7 Claims, 8 Drawing Sheets

(56) References Cited

U.S. PATENT DOCUMENTS

| | | | | |
|---|---|---|---|---|
| 6,546,566 | B1 * | 4/2003 | Geisel | A47K 11/12 4/144.1 |
| 8,875,930 | B2 | 11/2014 | Felicetti | |
| 9,605,420 | B1 | 3/2017 | Berger | |
| 9,637,906 | B1 * | 5/2017 | Charles | E03D 13/00 |
| 9,863,130 | B1 * | 1/2018 | Abram | E03C 1/304 |
| 2005/0055758 | A1 * | 3/2005 | Marston | E03D 11/11 4/321 |
| 2012/0246816 | A1 | 10/2012 | Jung | |
| 2014/0007978 | A1 * | 1/2014 | Cheikh | A47J 47/16 141/311 R |
| 2015/0089728 | A1 * | 4/2015 | Humphrey, Jr. | A47K 13/302 4/233 |
| 2015/0376888 | A1 * | 12/2015 | Chery | E03D 13/007 4/301 |
| 2016/0108609 | A1 * | 4/2016 | Escudero | A47K 13/24 4/300.3 |

* cited by examiner

EMESIS FUNNEL ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to funnel devices and more particularly pertains to a new funnel device for facilitating a person sitting on a toilet to vomit into the toilet.

BRIEF SUMMARY OF THE INVENTION

An embodiment of the disclosure meets the needs presented above by generally comprising a stand is removably positionable around a toilet. A funnel is coupled to the stand, the funnel has a top end and a bottom end, and the funnel tapers inwardly between the top and bottom ends. The funnel is positionable in a deployed position having the top end being aligned with the person's mouth and having the bottom end being directed between the user's legs toward the toilet. In this way the funnel can direct emesis into the toilet. A hose is coupled to the stand, the hose is fluidly coupled to a fluid source and a spray nozzle is fluidly coupled to the hose for washing vomit from the funnel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
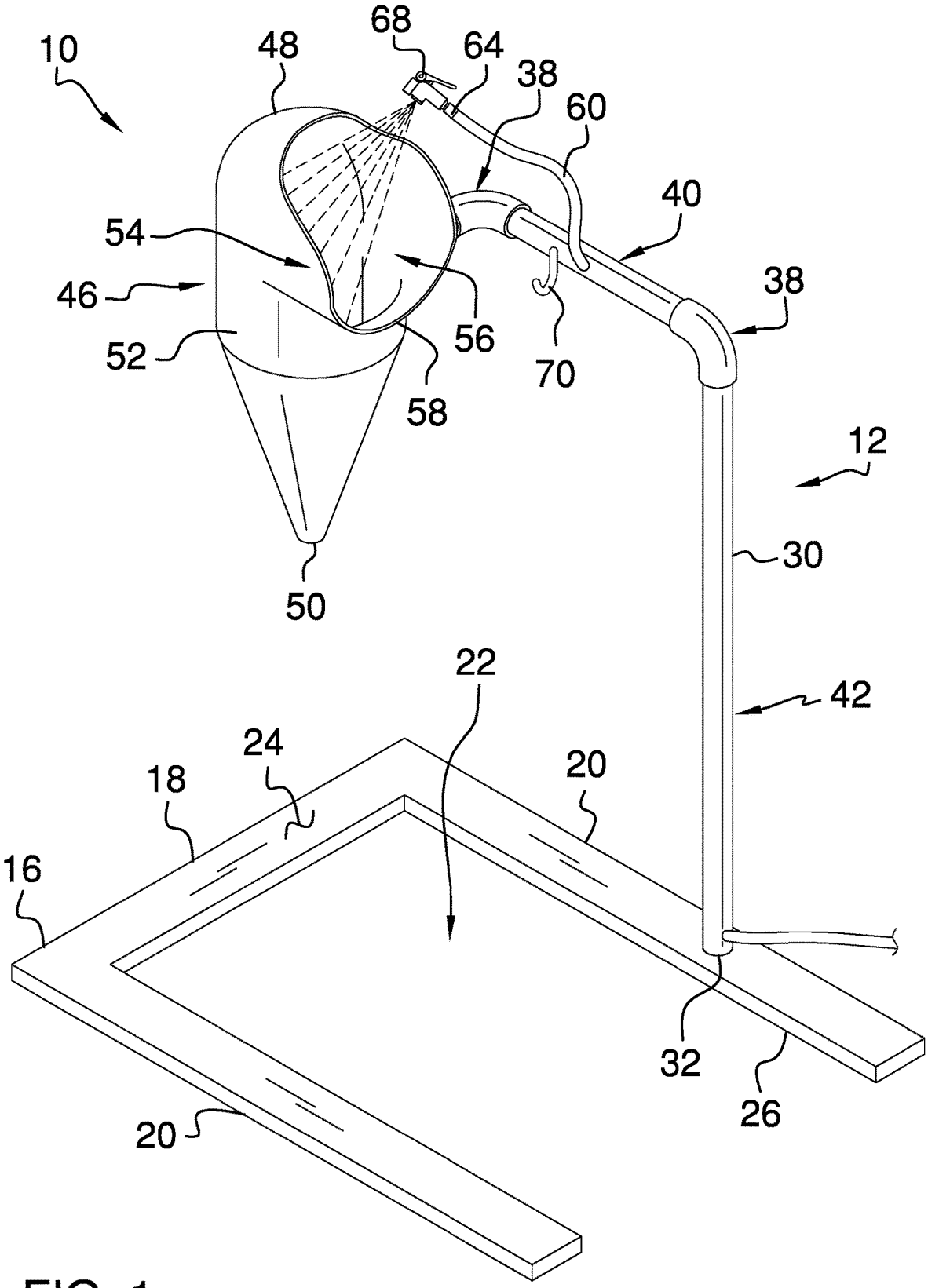
FIG. 1 is a front perspective view of an emesis funnel assembly according to an embodiment of the disclosure.
Figure 2:
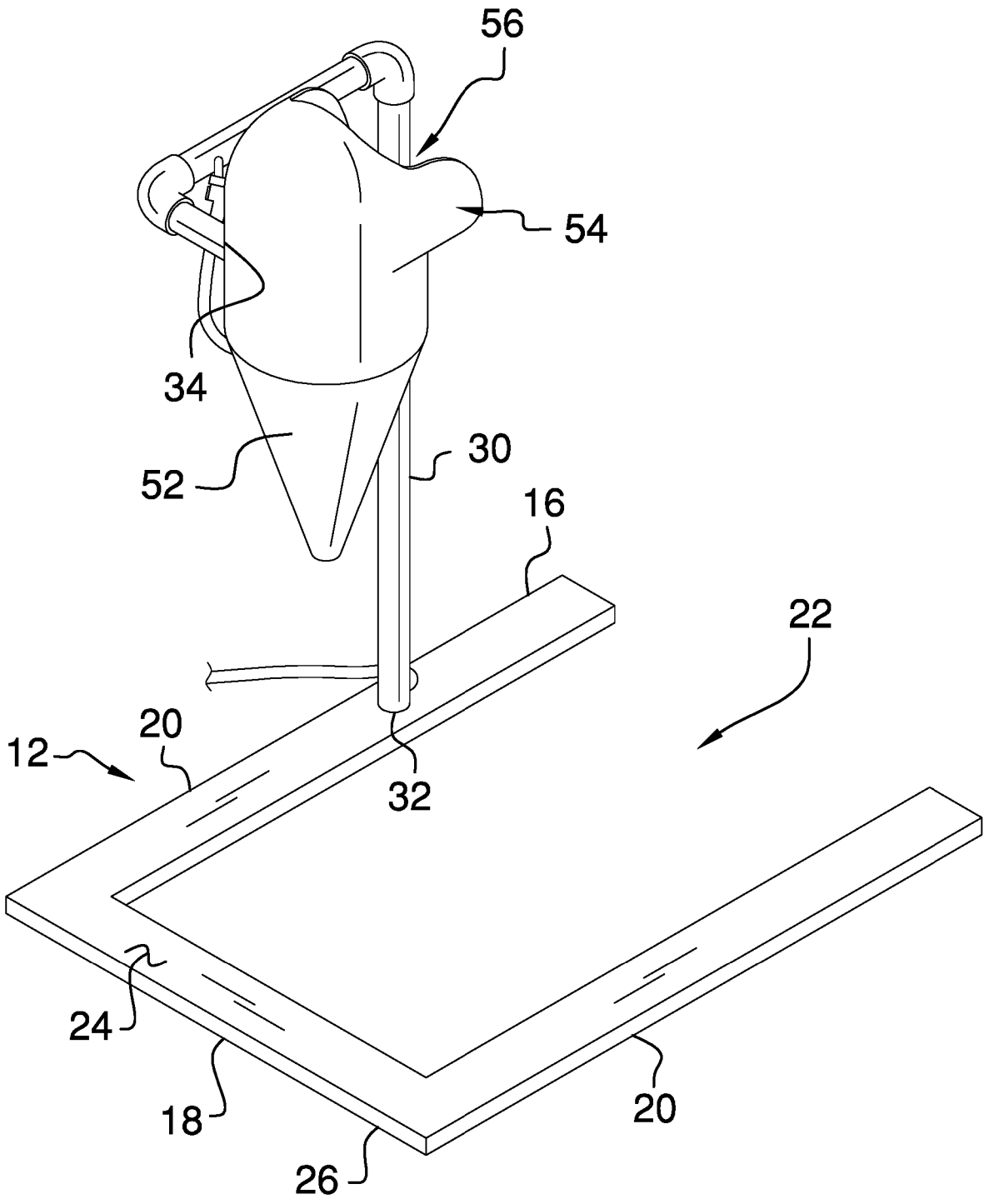
FIG. 2 is a back perspective view of an embodiment of the disclosure.
Figure 3:
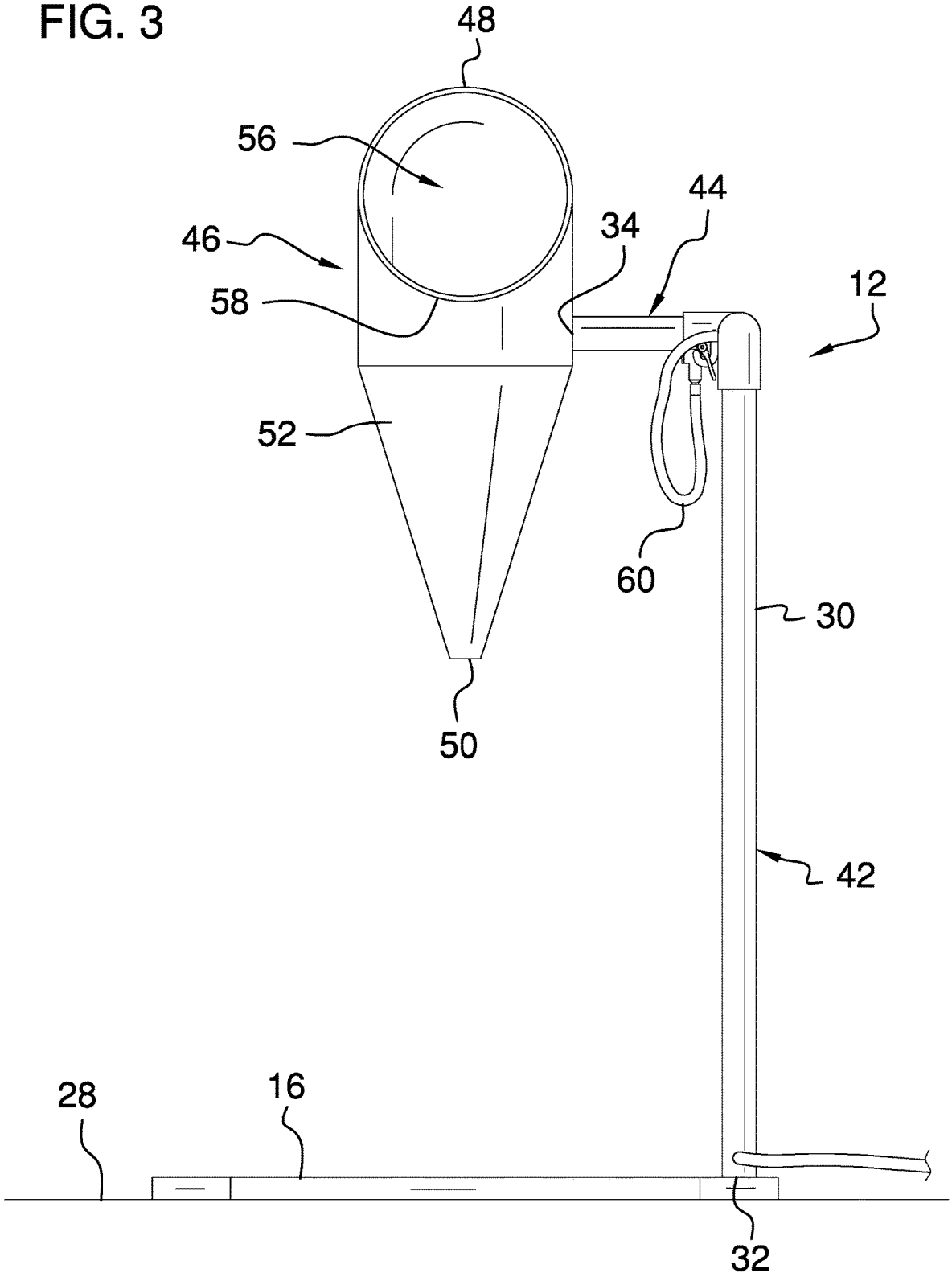
FIG. 3 is a front view of an embodiment of the disclosure.
Figure 4:
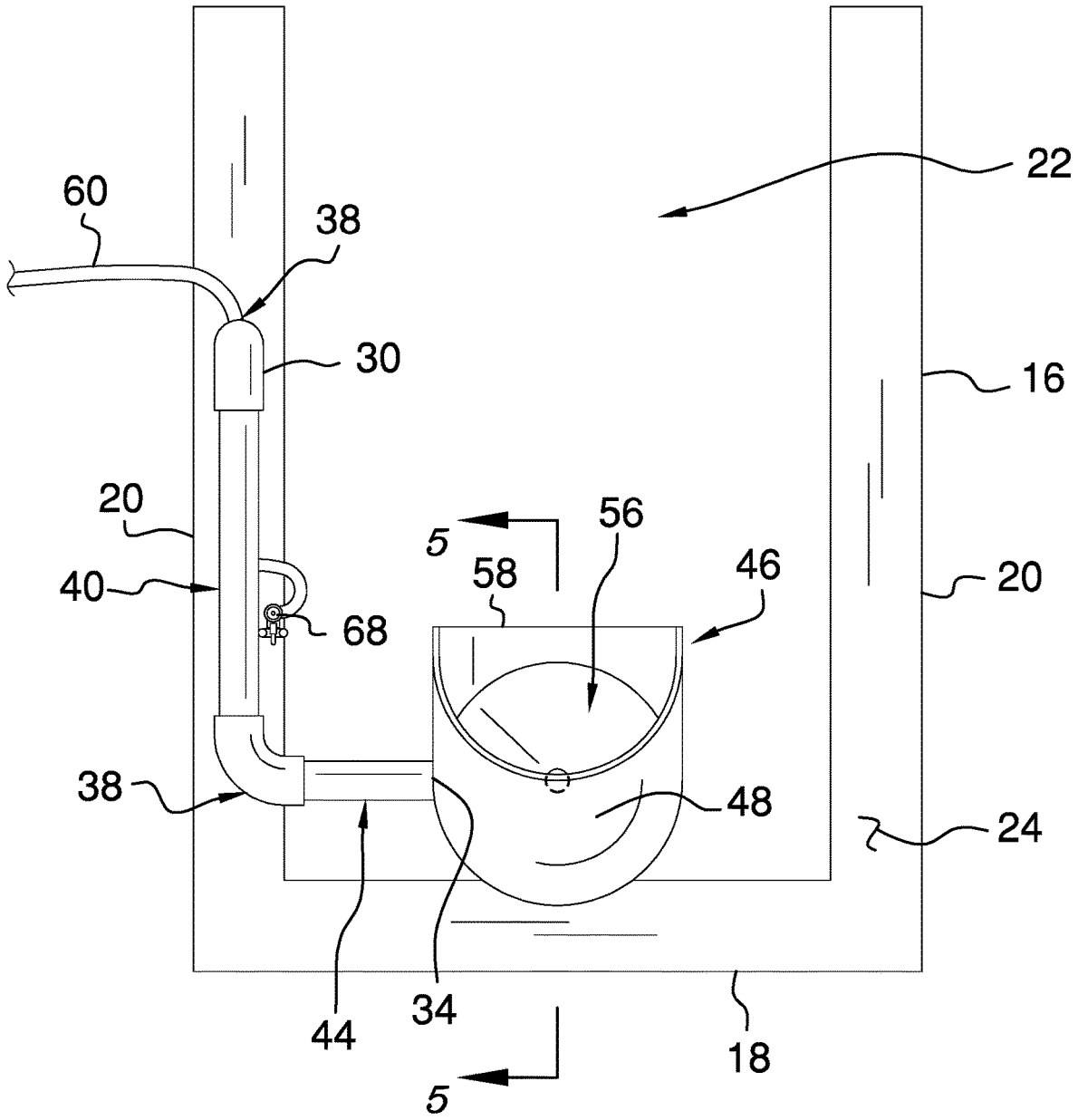
FIG. 4 is a top view of an embodiment of the disclosure.
Figure 5:
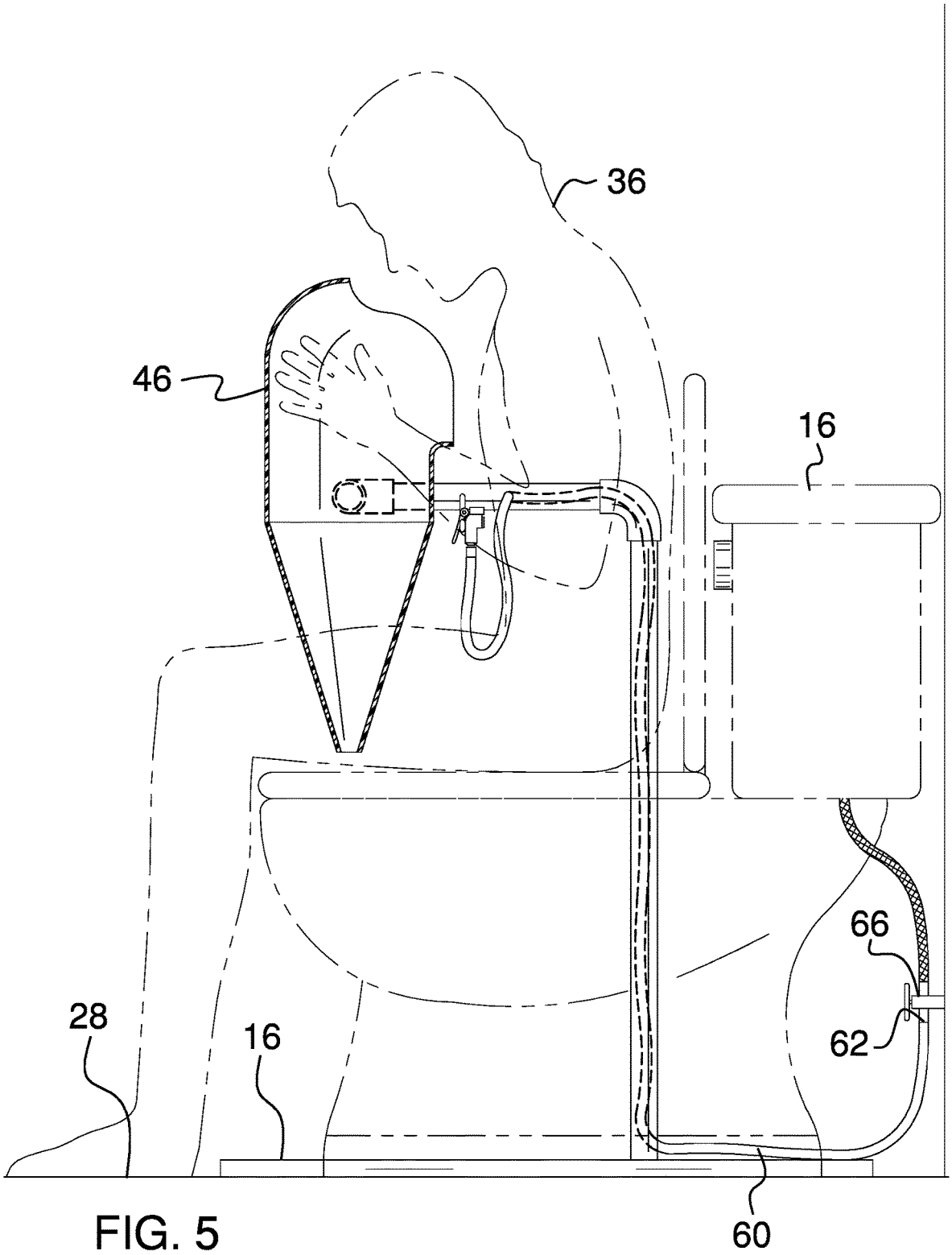
FIG. 5 is a perspective in-use view of an embodiment of the disclosure.

With reference now to the drawings, and in particular to FIGS. 1 through 8 thereof, a new funnel device embodying the principles and concepts of an embodiment of the disclosure and generally designated by the reference numeral 10 will be described.

As best illustrated in FIGS. 1 through 8, the emesis funnel assembly 10 generally comprises a stand 12 that is removably positionable around a toilet 14. The stand 12 comprises a base 16 that has a central member 18 extending between a pair of outward members 20 thereby defining a toilet space 22 between the outward members 20. Each of the central 18 and outward 20 members has a top surface 24 and a bottom surface 26. The bottom surface 26 rests on a support surface 28, such as a floor in a bathroom, having each of the outward members 20 extending alongside either side of a toilet 14 such that the toilet 14 is positioned in the toilet space 22.

The stand 12 includes a pole 30 that has a first end 32 and a second end 34. The first end 32 is rotatably coupled to the top surface 24 of a respective one of the outward members 20 having the pole 30 extending upwardly from the respective outward member. Thus, the pole 30 is positioned adjacent to a person 36 sitting on the toilet 14 when the base 16 is positioned around the toilet 14. The pole 30 has a sequence of bends 38 thereon defining a first horizontal portion 40 of the pole 30 that is oriented perpendicular to a vertical portion 42 of the pole 30 and a second horizontal portion 44 of the pole 30 that is oriented perpendicular to the first horizontal portion 40. The second horizontal portion 44 has the second end 34 of the pole 30 associated therewith.

Each of the first 42 and second 44 horizontal portions is oriented to lie on a horizontal plane. The pole 30 is rotatable into a deployed position having the second horizontal portion 44 of the pole 30 being positioned above the toilet space 22. Thus, the second horizontal portion 44 can be swung in front of the person 36 sitting on the toilet 14 when the pole 30 is in the deployed position. The toilet 14 may be a plumbing fixture of any conventional design, including ADA compliant toilets, residential toilets and institutional toilets.

A funnel 46 is coupled to the stand 12, the funnel 46 has a top end 48 and a bottom end 50, and the funnel 46 tapers inwardly between the top 48 and bottom 50 ends. Moreover, the funnel 46 is positionable in a deployed position having the top end 48 being aligned with the person's 36 mouth and having the bottom end 50 being directed between the person's 36 legs toward the toilet 14. In this way the funnel 46 directs emesis into the toilet 14 when the person 36 is sitting on the toilet 14 without requiring the person 36 to assume a special posture to accommodate emesis.

The funnel 46 has an outer wall 52 extending between the top 48 and bottom 50 ends, and the outer wall 52 curves laterally away from an axis extending through the top 48 and bottom 50 ends. Thus, a hood portion 54 of the funnel 46 is defined that is oriented perpendicular to the axis. The bottom end 50 is open and the hood portion 54 has an opening 56 extending therethrough. The opening 56 extends from a lower threshold 58 of the hood portion 54 upwardly along the top end 48 of the funnel 46.

The outer wall 52 of the hood portion 54 is coupled to the second end 34 of the pole 30 such that the funnel 46 is centrally positioned over the toilet space 22 when the pole 30 is positioned in the deployed position. Moreover, the hood portion 54 is directed rearwardly with respect to the central member 18 when the pole 30 is positioned in the deployed position. In this way the opening 56 accommodates the person's 36 face having the hood portion 54 extending beneath the person's 36 chin and having the top end 48 of the funnel 46 being aligned with the person's 36 forehead. Thus, the hood portion 54 reduces spillage during emesis onto the toilet 14 or the user.

A hose 60 is coupled to the stand 12, and the hose 60 has a first end 62 and a second end 64. The first end 62 of the hose 60 is fluidly coupled to a fluid source 66, such as the water supply line of the toilet 14. The hose 60 extends upwardly along the vertical portion 42 of the pole 30 and substantially along the first horizontal portion 40 of the pole 30. In this way the hose 60 is extendable into the funnel 46. A spray nozzle 68 is fluidly coupled to the hose 60 for washing vomit from the funnel 46 and the spray nozzle 68 is positioned on the second end 64 of the hose 60. The spray nozzle 68 is positionable between an open position for spraying the fluid and a closed position to inhibit the fluid from spraying. A hook 70, or other suspension support, is coupled to the first horizontal portion 40 of the pole 30 and the hose 60 can be suspended thereon for storage.

Figure 6:
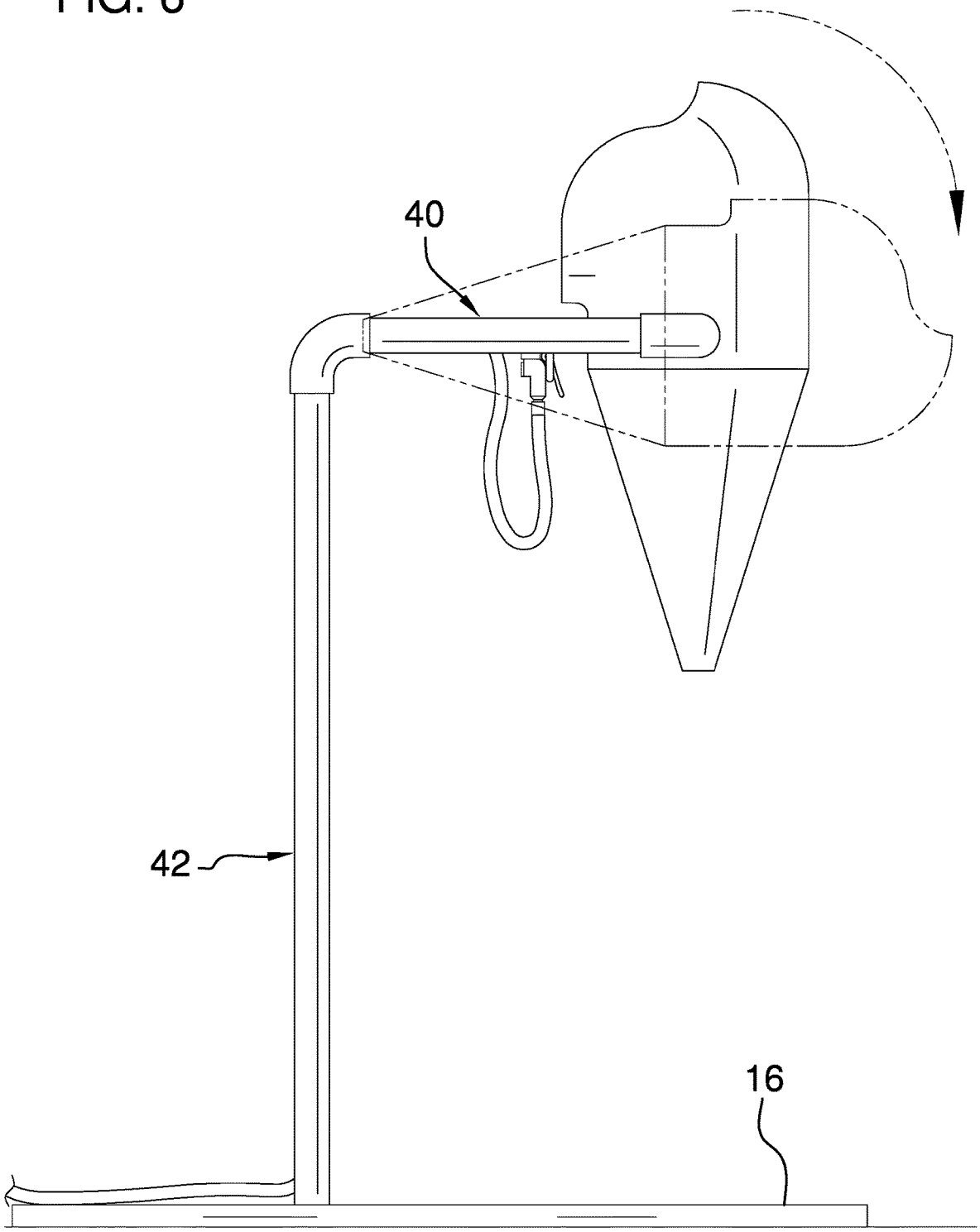
FIG. 6 is a left side view of an embodiment of the disclosure showing a funnel being rotated on a second horizontal portion.
Figure 7:
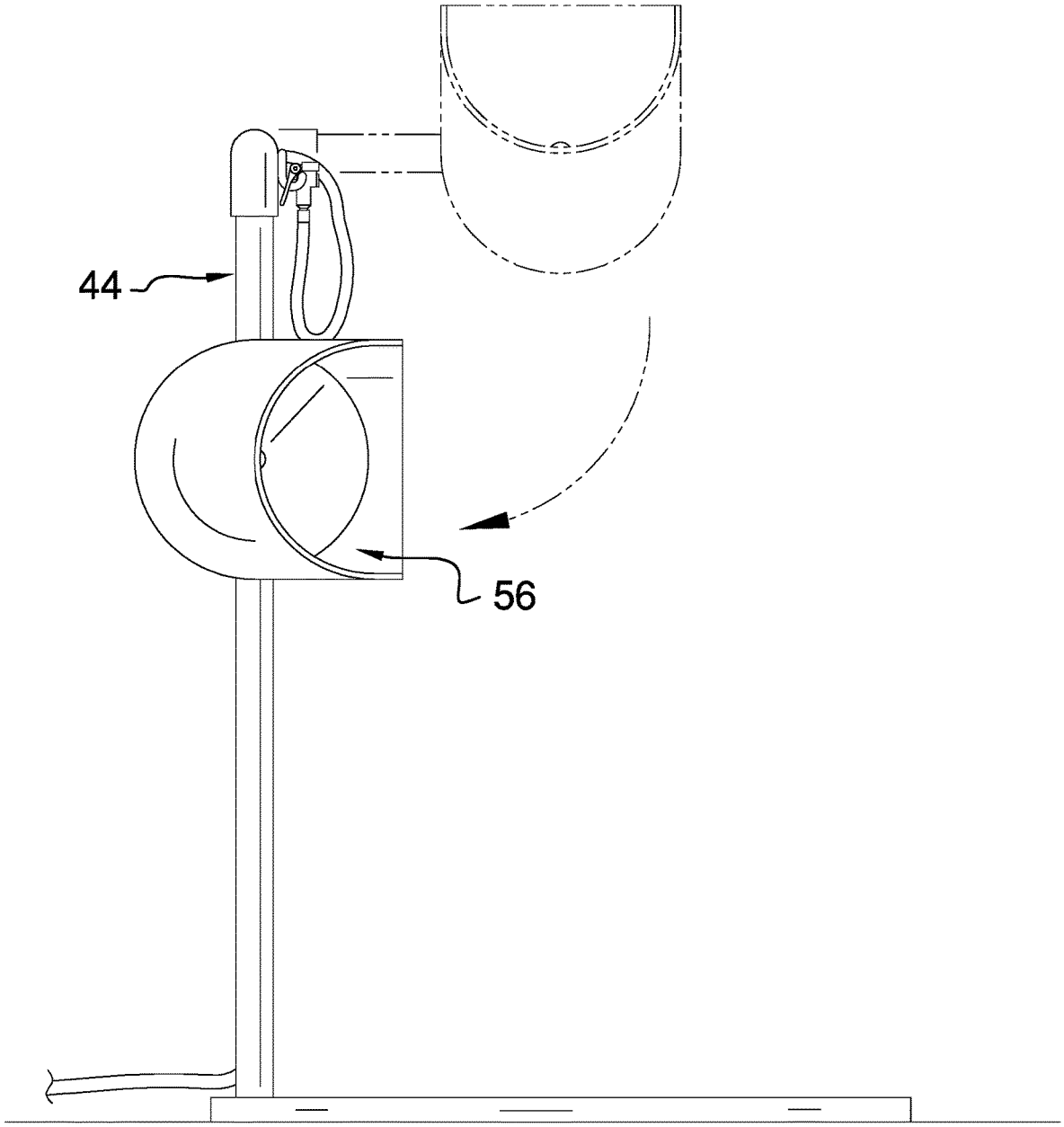
FIG. 7 is a left side view of an embodiment of the disclosure showing a second horizontal portion being rotated on a first horizontal portion.
Figure 8:
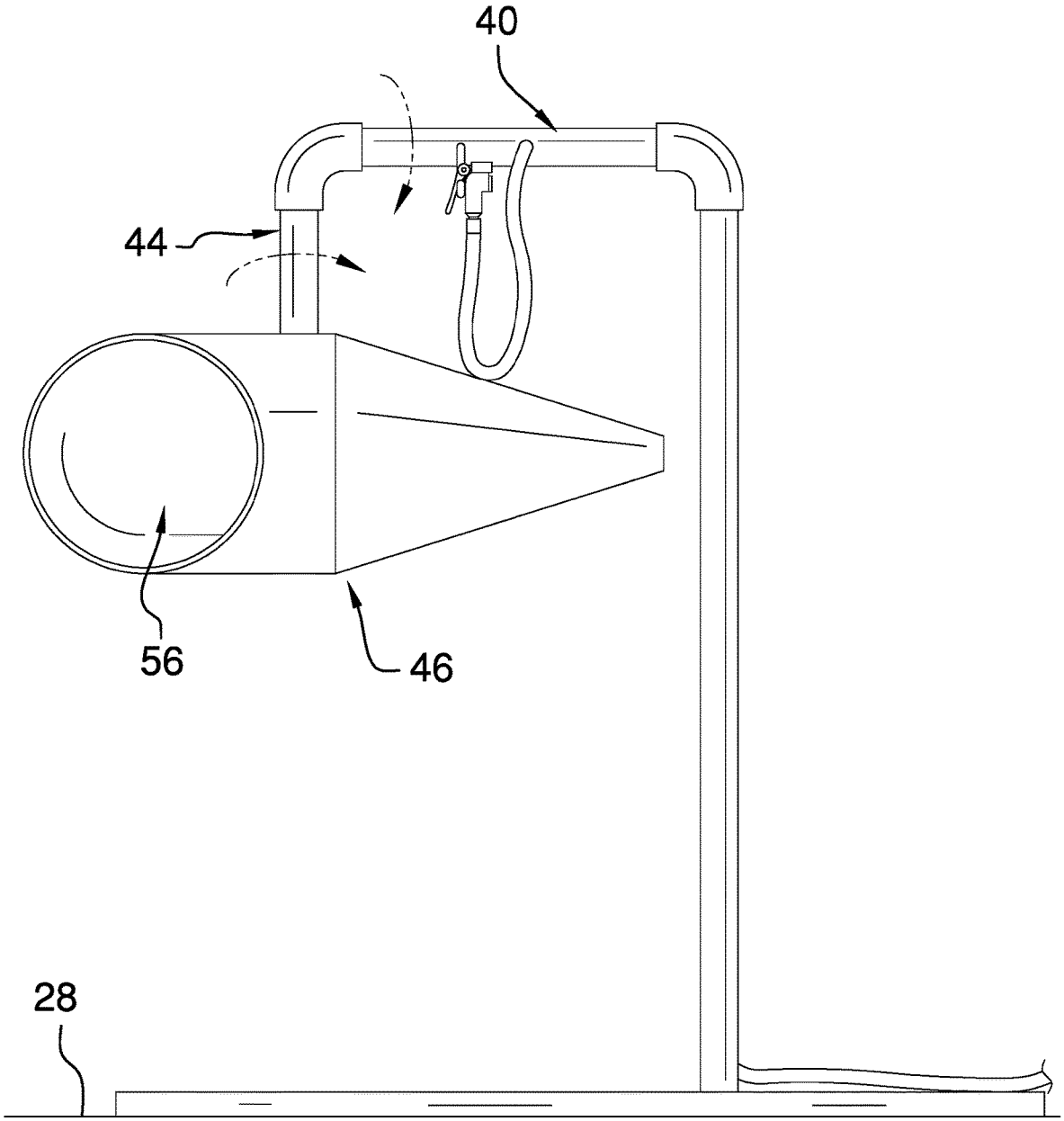
FIG. 8 is a right side view of an embodiment of the disclosure.

As shown in FIG. 6, the funnel 46 is rotatably coupled to the second end 34 of the pole 30. Thus, the funnel 46 can be rotated about a longitudinal axis of the second horizontal portion 44 of the pole 30. As shown in FIG. 7, the second horizontal portion 44 of the pole 30 is rotatably coupled to the first horizontal portion 40 of the pole 30. Thus, the second horizontal portion 44 can be rotated into a vertical orientation. As shown in FIG. 8, the second horizontal portion 44 of the pole 30 is positioned in the vertical orientation and the funnel 46 is rotated on the second horizontal portion 44.

In use, the base 16 is positioned around the toilet 14 when the person 36 is suffering from a stomach illness, food poisoning or other ailment known to cause emesis. The pole 30 is rotated into the deployed position when the person 36 sits on the toilet 14 thereby positioning the funnel 46 in front of the person 36. In this way the person 36 can vomit into the funnel 46 while sitting on the toilet 14, and without assuming a posture other than the conventional posture of defecating on a toilet 14. Additionally, the funnel 46 facilitates the person 36 to vomit simultaneously while defecating in the event that the person 36 is suffering from emesis and diarrhea. The funnel 46 can be washed with the hose 60 at any time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An emesis funnel assembly being configured to be placed over a toilet thereby facilitating simultaneous emesis and defecation, said assembly comprising:

a stand being removably positionable around a toilet, said stand comprising a base having a central member extending between a pair of outward members thereby defining a toilet space between said outward members, each of said central and outward members having a top surface and a bottom surface, said bottom surface resting on a support surface having each of said outward members extending alongside either side of a toilet such that the toilet is positioned in said toilet space;

a funnel being coupled to said stand, said funnel having a top end and a bottom end, said funnel tapering inwardly between said top and bottom ends, said funnel being positionable in a deployed position having said top end being aligned with the person's mouth and having said bottom end being directed between the user's legs toward the toilet wherein said funnel is configured to direct emesis into the toilet;

a hose being coupled to said stand, said hose being fluidly coupled to a fluid source;

a spray nozzle being fluidly coupled to said hose for washing vomit from said funnel;

said stand comprising a pole having a first end and a second end, said first end being coupled to said top surface of a respective one of said outward members having said pole extending upwardly from said respective outward member wherein said pole is configured to be positioned adjacent to a person sitting on the toilet;

said pole having a sequence of bends thereon defining a first horizontal portion of said pole being oriented perpendicular to a vertical portion of said pole and a second horizontal portion of said pole being oriented perpendicular to said first horizontal portion, said second horizontal portion having said second end of said pole being associated therewith, each of said first and second horizontal portions being oriented to lie on a horizontal plane; and said pole being rotatable on said respective outward member wherein said second horizontal portion of said pole is configured to be swung in front of the person sitting on the toilet.

2. The assembly according to claim 1, wherein said funnel has an outer wall extending between said top and bottom ends, said outer wall curving laterally away from an axis extending through said top and bottom end to define a hood portion of said funnel being oriented perpendicular to said axis, said bottom end being open.

3. The assembly according to claim 2, wherein said hood portion has an opening extending therethrough, said opening extending from a lower threshold of said hood portion upwardly along said top end of said funnel.

4. The assembly according to claim 3, wherein said outer wall of said hood portion is coupled to said second end of said pole such that said funnel is centrally positioned over said toilet space when said pole is positioned in said deployed position, said hood portion being directed rearwardly with respect to said central member when said pole is positioned in said deployed position wherein said opening is configured to accommodate the user's face having said hood portion extending beneath the user's chin and having said top end of said funnel being aligned with the user's forehead.

5. The assembly according to claim 1, wherein said hose has a first end and a second end, said first end being fluidly coupled to a fluid source, said hose extending upwardly along said vertical portion of said pole and substantially along said first horizontal portion of said pole such that said hose is extendable into said funnel.

6. The assembly according to claim 5, wherein said spray nozzle is positioned on said second end of said hose, said spray nozzle being positionable between an open position for spraying the fluid and a closed position to inhibit the fluid from spraying.

7. An emesis funnel assembly being configured to be placed over a toilet thereby facilitating simultaneous emesis and defecation, said assembly comprising:

a stand being removably positionable around a toilet, said stand comprising:

a base having a central member extending between a pair of outward members thereby defining a toilet space between said outward members, each of said central and outward members having a top surface and a bottom surface, said bottom surface resting on a support surface having each of said outward members extending alongside either side of a toilet such that the toilet is positioned in said toilet space; and a pole having a first end and a second end, said first end being rotatably coupled to said top surface of a respective one of said outward members having said pole extending upwardly from said respective outward member wherein said pole is configured to be positioned adjacent to a person sitting on the toilet, said pole having a sequence of bends thereon defining a first horizontal portion of said pole being oriented perpendicular to a vertical portion of said pole and a second horizontal portion of said pole being oriented perpendicular to said first horizontal portion, said second horizontal portion having said second end of said pole being associated therewith, each of said first and second horizontal portions being oriented to lie on a horizontal plane, said pole being rotatable into a deployed position having said second horizontal portion of said pole being positioned above said toilet space wherein said second horizontal portion is configured to be swung in front of the person sitting on the toilet;

a funnel being coupled to said stand, said funnel having a top end and a bottom end, said funnel tapering inwardly between said top and bottom ends, said funnel being positionable in a deployed position having said top end being aligned with the person's mouth and having said bottom end being directed between the user's legs toward the toilet wherein said funnel is configured to direct emesis into the toilet, said funnel having an outer wall extending between said top and bottom ends, said outer wall curving laterally away from an axis extending through said top and bottom end to define a hood portion of said funnel being oriented perpendicular to said axis, said bottom end being open, said hood portion having an opening extending therethrough, said opening extending from a lower threshold of said hood portion upwardly along said top end of said funnel, said outer wall of said hood portion being coupled to said second end of said pole such that said funnel is centrally positioned over said toilet space when said pole is positioned in said deployed position, said hood portion being directed rearwardly with respect to said central member when said pole is positioned in said deployed position wherein said opening is configured to accommodate the user's face having said hood portion extending beneath the user's chin and having said top end of said funnel being aligned with the user's forehead;

a hose being coupled to said stand, said hose having a first end and a second end, said first end being fluidly coupled to a fluid source, said hose extending upwardly along said vertical portion of said pole and substantially along said first horizontal portion of said pole such that said hose is extendable into said funnel;

a spray nozzle being fluidly coupled to said hose for washing vomit from said funnel, said spray nozzle being positioned on said second end of said hose, said spray nozzle being positionable between an open position for spraying the fluid and a closed position to inhibit the fluid from spraying; and a hook being coupled to said first horizontal portion of said pole, said hose being suspended thereon for storage.

* * * * *